United States Patent [19]

Addis

[11] 4,133,106

[45] Jan. 9, 1979

[54] FOLDING LOCKING BLADE KNIFE

[75] Inventor: Carl J. Addis, Casper, Wyo.

[73] Assignee: Wyoming Knife Corporation, Casper, Wyo.

[21] Appl. No.: 852,201

[22] Filed: Nov. 17, 1977

[51] Int. Cl.[2] ..... B26B 1/04

[52] U.S. Cl. ..... 30/160

[58] Field of Search ..... 30/156, 158, 159, 160, 30/161

[56] References Cited

U.S. PATENT DOCUMENTS

| | | | |
|---|---|---|---|
| 488,340 | 12/1892 | Skoglund | 30/160 |
| 749,230 | 1/1904 | Severance | 30/160 |
| 915,269 | 3/1909 | Chemienes | 30/160 |
| 1,350,251 | 8/1920 | Armour | 30/160 |
| 1,353,490 | 9/1920 | Pantalek | 30/160 |
| 1,965,291 | 7/1934 | Kowald | 30/160 |
| 2,199,430 | 5/1940 | Greve | 30/160 |

*Primary Examiner*—J. C. Peters

*Attorney, Agent, or Firm*—Sheridan, Ross, Fields & McIntosh

[57] ABSTRACT

A folding knife has a blade and a pair of overlying scales all mounted on a pivot post. A lock pin and lock hole on the scales retain them in registry for blade use or storage. A stud on one scale engages a semi-circular slot in the blade and swings it to an extended position during a full turn of the scale around the pivot post, and a corresponding turn in the reverse direction retracts the blade. A blade guard between the scales serves as a stop or abutment for two different parts of the tange of the blade to limit extension and retraction. Spring means are built into the pivot post to yieldingly press the lock pin into the lock hole to prevent unintentional movement.

7 Claims, 17 Drawing Figures

FOLDING LOCKING BLADE KNIFE

BACKGROUND OF THE INVENTION

This invention lies in the field of folding knives and is directed toward the type of knife used by hunters and fishermen although it is not so limited. It is directed primarily toward such a knife which has a minimum number of parts, which can be readily assembled and disassembled with practically no tools, and which operates reliably under all ordinary conditions.

Many varieties of folding knives for both home and sport use have been produced and used over the years. The best known style is the simple pocket knife with a body to receive blades, the blades themselves mounted on one or more pivot pins in the body, and spring backs to engage the tangs of the knives and hold them selectively in open or closed position. These knives are satisfactory for ordinary home use but are dangerous for use in the field because the spring backs allow the blades to snap shut under loads and cut the fingers of the users.

Another, frequently referred to as a switch-blade type, has a blade which is spring loaded to open position and is held closed by a finger operated latch. When it snaps open, a positive lock engages the tang to prevent unintentional closure.

Still another type, referred to as the split-handle type, generally comprises a pair of handle sections with a blade located between them and a pivot pin passing through the ends of the components. Arcuate slots are formed in the handle sections, concentrically with the pivot apertures, and studs are mounted in the pivot ends of the blades to engage in the slots. With the studs and slots properly located they will interact to extend the blade 180 degrees when the second handle section is swung 360 degrees about the pivot pin in a first direction with respect to the first handle section and to retract the blade in response to the opposite movement and store the blade between the handle sections. The handle sections are held in their overlying registered positions by latch means of various sorts. To separate the latch means they employ loose pivot pins or flexible and flimsy handle sections. The result is poor latching. The excessive number of parts and the loose construction leave much to be desired in knives of this type.

PRIOR ART STATEMENT

The following references are submitted under the provisions of 37 CFR 1.97(b) as having come to the attention of Applicant:

226,910: Friebertshauser
357,353: Wiesner
488,340: Skoglund
927,352: Hoglund
338,251: Crandall
3,702,501: Wood These references are generally similar and correspond to the construction described above, having two handle portions and a blade on a pivot pin, studs on the blade, and arcuate slots in the handle portion, and operable to swing a blade 180 degrees by rotation of a handle portion 360 degrees. Wood shows the alternative of providing the slots in the knife blade and the studs in the handle sections.

SUMMARY OF THE INVENTION

The present invention provides a split-handle or folding locking blade knife which requires very few parts and can be assembled and disassembled easily and rapidly, which locks well in the closed overlying position of the handle sections yet unlocks very easily for manipulation.

Generally stated, in its presently preferred form, the knife includes first and second side scales, each having a pivot end, a free end, and a pivot aperture in the pivot end, the two scales being substantially identical in planform. A long narrow blade guard is fixedly mounted on the inner face of the first scale and extends only along the rear margin and the free end marginal portion of the scale and it terminates short of the pivot end of the scale.

A pivot post passes through both of the pivot apertures with only slight working clearance and retains the two scales in assembled relation spaced apart by the blade guard so that the assemblage provides a protective pocket for a retracted blade.

A cutting blade is provided which has a pivot end or tang, a free end, and a pivot aperture in the tang. It is located between the two scales and is pivotally mounted by its aperture on the pivot post for rotation between retracted and extended positions.

A lock pin projects from the inner face of the blade guard near the free end of the scale and a lock hole is formed through the second scale. When the two scales are in registry the pin engages the hole and locks the scales against relative rotation. The scales are made extra thick and very rigid so that they take the place of the scale and the cover of a conventional knife. The pivot post includes a sleeve having an enlarged head and a stem threaded into the sleeve and having an enlarged head. When the two components are tightly screwed together with spring washers under the heads, the scales are locked against relative rotation. When it is desired to manipulate the blade, the free ends of the scales are pressed apart against the yielding force of the spring washers.

An arcuate slot is formed in the tang of the blade and a stud is provided on the inner face of the pivot end of the second scale. They are so located that when the blade is retracted the stud is in a first end of the slot. As the second scale is released and swung out, the stud travels the length of the slot without moving the blade. After about 180 degrees of movement the stud strikes the end of the slot and swings the blade to full extended position as the scale finishes its 360 degree travel. The reverse of the above retracts the blade.

The tang of the blade is unconventional since it maintains practically the full width of the blade to the butt end. When the second scale has turned 360 degrees in the opening direction it could still rotate the blade except that the butt end rear corner of the tang positively engages the blade guard. Thus, with the second scale locked in position, the blade is locked against retraction or further extension. When the blade is retracted the tang front contacts the side edge of the forward portion of the blade guard, and again the blade is locked against extension and retraction.

BRIEF DESCRIPTION OF THE DRAWINGS

Various other advantages and features of novelty will become apparent as the description proceeds in conjunction with the accompanying drawings, in which.

DESCRIPTION OF PREFERRED EMBODIMENTS

Figure 1:
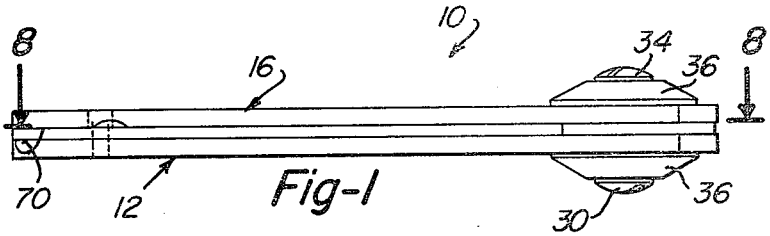
FIG. 1 is an elevational view of the closed knife, looking at the back edge.
Figure 4:
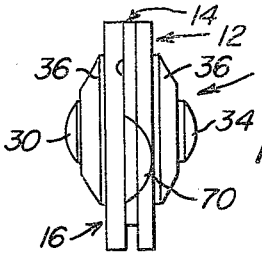
FIG. 4 is an end view of the knife of FIG. 3, looking at the free end.
Figure 2:
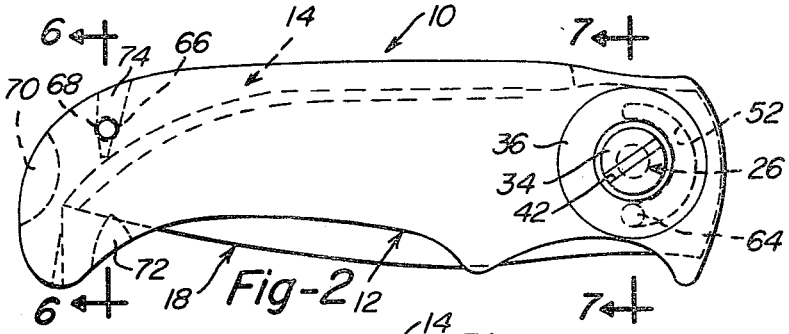
FIG. 2 is a plan view of the knife of FIG. 1.
Figure 3:
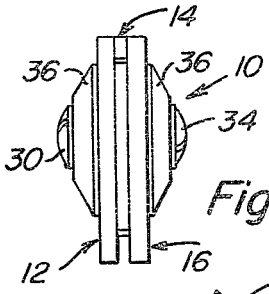
FIG. 3 is an end view of the knife of FIG. 3, looking at the pivot end.
Figure 5:
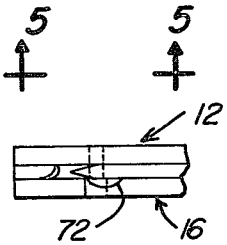
FIG. 5 is a fragmentary side elevational view looking from line 5—5 of FIG. 2.
Figure 6:
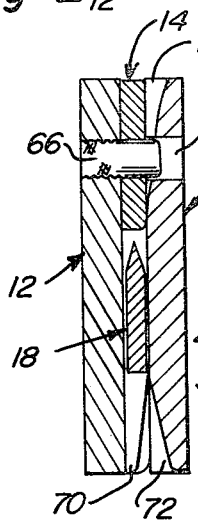
FIG. 6 is a sectional view taken on line 6—6 of FIG. 2.

A knife embodying the principles of the invention is illustrated in FIGS. 1 to 9, in which the frame 10 includes a first scale 12, a blade guard 14, a second scale 16, and a cutting blade 18. The blade guard is narrow and elongate, stopping short of the pivot end of the scale 12 and expanding and spreading across the free end of the scale while being confined to the back edge of the scale throughout. It is fixedly mounted on the inner face of the scale by any suitable means such as rivets, although welding is preferred. Scale 12 is formed with a pivot aperture 20, scale 16 is formed with a pivot aperture 22, and blade 18 is formed with a pivot aperture 24. The pivot apertures are all of the same size and are in registry with each other when the scales which are substantially identical in planform are arranged in matching overlying relation spaced apart by the blade guard to form a pocket and the blade 18 is located in the pocket.

Figure 7:
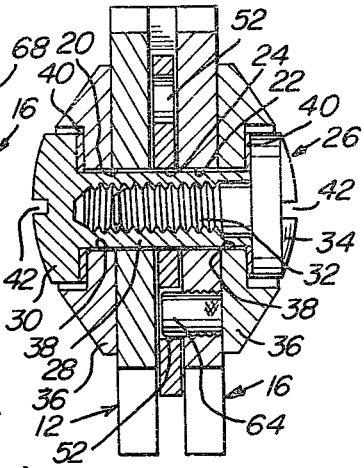
FIG. 7 is a sectional view taken on line 7—7 of FIG. 2.

To maintain the assembled relation of the components, a pivot post 26 is provided. The post, as best seen in FIG. 7, includes an internally threaded sleeve 28 having an enlarged head 30 and an externally threaded stem 32 having an enlarged head 34. The stem is shorter than the bore and is reached into the sleeve until the free end of the sleeve contacts the underside of head 34. Counterbored washers 36 have bores 38 to receive sleeve 28, and a spring washer 40 is seated in each counterbore. The washers are made of resilient steel and are non-planar, of a type sometimes known as modified Belville.

The dimensions of the components of the pivotal assemblage parallel to the axis of sleeve 28 are very precise so that when the sleeve and stem are reached together the two scales will be pressed tightly against the blade, and the two washers 36 will be pressed tightly against the scales, but the spring washers 40 in the counterbores will not be pressed quite flat. Consequently the clamping pressure is resilient, not rigid. The working clearance between sleeve 28 and the pivot apertures is just loose enough to allow each of the components to rock a few degrees on the sleeve for a purpose to be described. Slots 42 in heads 34 are dimensioned to receive a penny or other coin for tightening the stem thoroughly in the sleeve.

The general theory of the type of knife disclosed herein is that a pair of scales and a blade guard provide a pocket in which a blade may be stored in safety but the components are not all fixedly related to each other. The opening of the knife, or the extension of the blade, is accomplished by using scales which are pivoted with respect to each other and to the blade and are connected to the blade to cause it to extend 180 degrees while one scale swings pivotally around the other through a full circle of 360 degrees.

Figure 9:
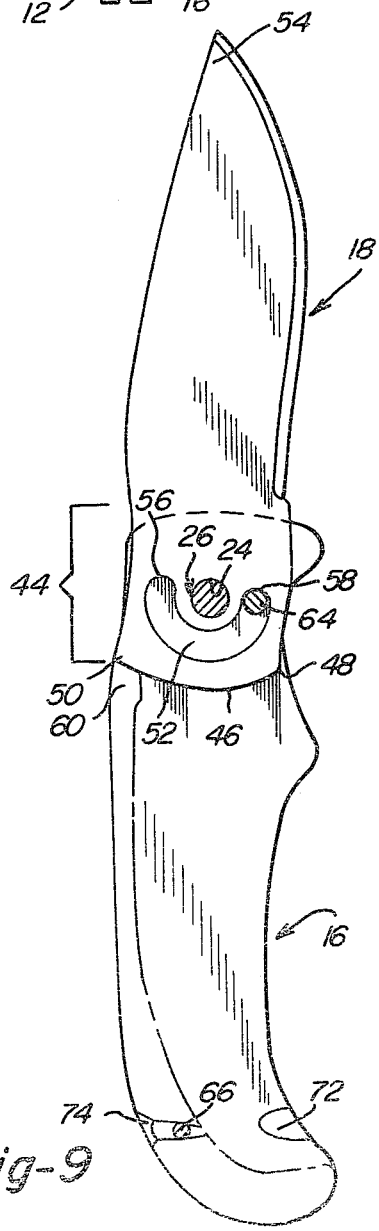
FIG. 9 is an inverted plan view similar to FIG. 8, showing the blade in extended position.
Figure 8:
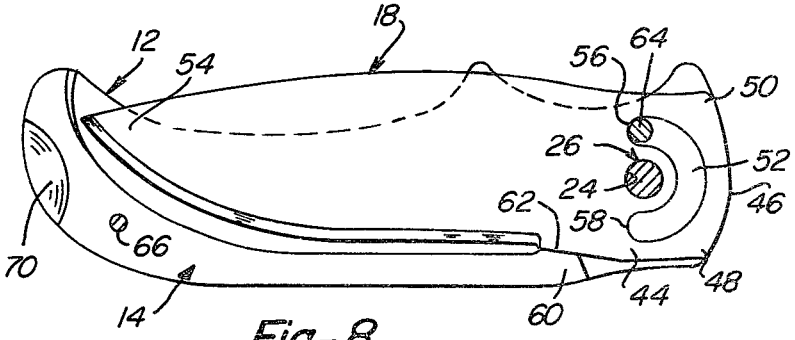
FIG. 8 is a partly sectional plan view taken on line 8—8 of FIG. 1, with the blade in retracted position.

In the construction embodying the invention, blade 18 is provided with a pivot aperture 24 as previously mentioned for mounting the blade on the pivot post between the scales. As seen in FIGS. 8 and 9 the tang 44 of the blade is substantially the full width of the blade all the way back to the butt edge or margin 46 which extends laterally across to form the forward and back corners 48 and 50. An arcuate slot 52 is formed through the tang 44 at the side of aperture 24 remote from the free end or point 54 of the blade. The slot is centered on the aperture 24 and extends around it in an arc of substantially 180 degrees with its ends 56 and 58 in a lateral line across the blade passing through the pivot aperture 24.

The limits of movement of blade 18 around pivot post 26 are determined by the relation of tang 44 to the abutment 60 constituting the end of blade guard 14 nearest to pivot aperture 24. When the blade swings into the pocket the area 62 of the tang front contacts the side of abutment 60 and causes the blade to lie as shown in FIG. 8 with the edge protected by guard 14. When the blade swings out substantially 180 degrees to extend position the back corner 50 of the tang contacts the end of abutment 60 and stops the travel. Butt edge 46 is generally arcuate on a radius of curvature substantially larger than that of the arcuate slot and corresponds generally with the curvature of the pivot ends of the scales. The corner portion 48 terminates forward of corner portion 50 to provide clearance for passage of corner 48 past abutment 60 during swinging of the blade between retracted and extended positions.

Figure 14:
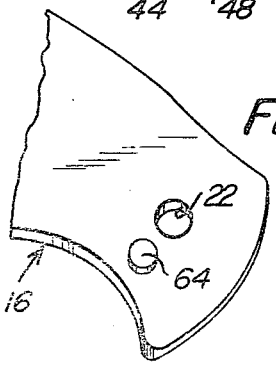
FIG. 14 is a perspective view of the pivot end of the second scale.

The movement of blade 18 around pivot post 26 between retracted and extended positions is caused and controlled by second scale 16 which is best shown in FIGS. 9 and 14. It is the same planform as scale 12 and planar on its inner face, having no blade guard. It is provided with a single stud 64 which projects from the inner face of the scale and is spaced laterally from pivot aperture 22 a distance corresponding to the radius of slot 52.

Figure 10:
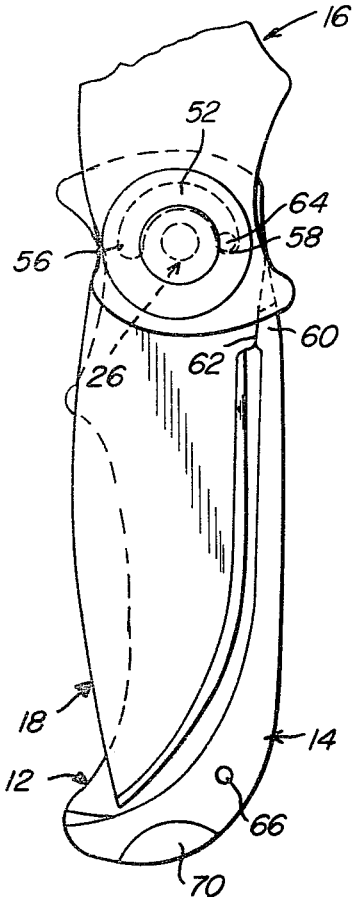
FIG. 10 is a view similar to FIG. 8 but showing the second scale swung 180 degrees.
Figure 11:
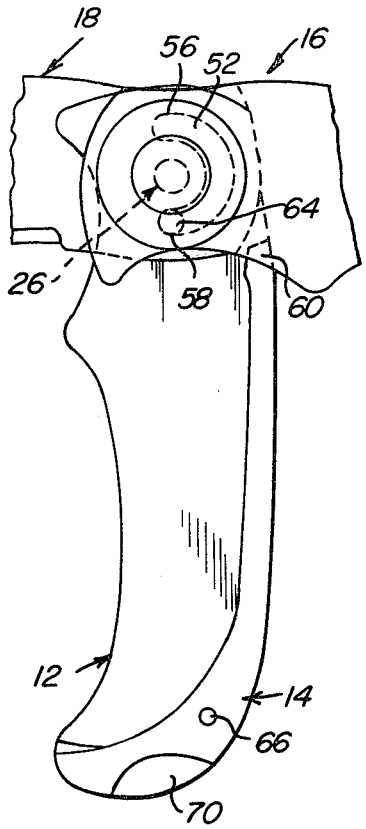
FIG. 11 is a view similar to FIG. 10 with the second scale swung 270 degrees.
Figure 12:
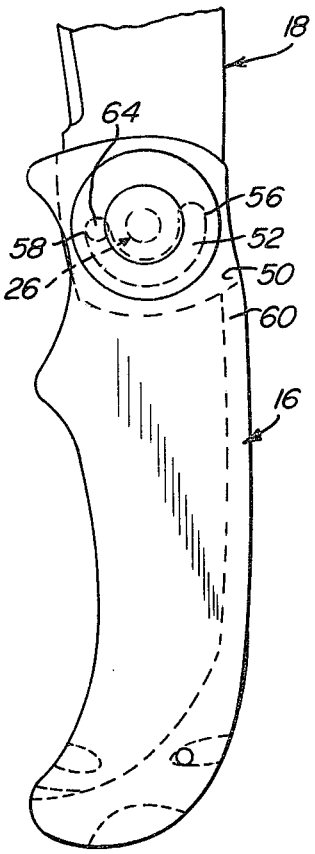
FIG. 12 is a view similar to FIG. 10 with the second scale swung 360 degrees.
Figure 13:
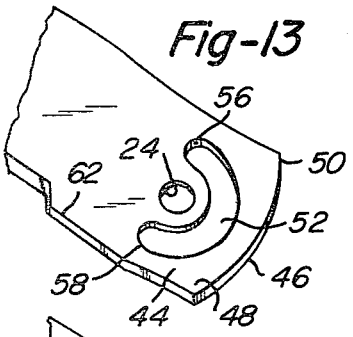
FIG. 13 is a perspective view of the pivot end or tang of the blade.
Figure 15:
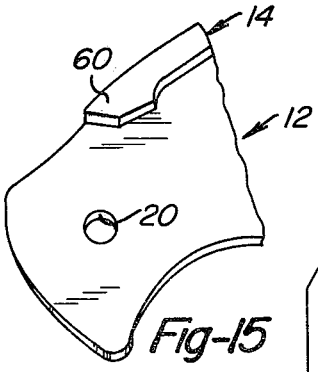
FIG. 15 is a perspective view of the pivot end of the first scale.
Figure 16:
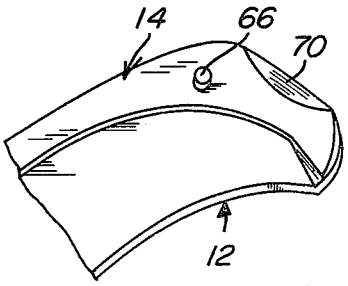
FIG. 16 is a perspective view of the free end of the first scale.

Considering FIG. 8, it will be apparent that, in assembling the knife, scale 16 will be laid over scale 12 and blade 18 and lie in contact with blade guard 14, with pivot aperture 22 mounted on post 26. In this attitude the blade is retracted in the pocket and stud 64 is engaged in slot 52 at its first end 56. The pivot post is of course fully tightened to maintain the assembly. To extend the blade, scale 16 is rotated clockwise as viewed in the drawings with respect to scale 12 which is considered to be stationary. During the first 180 degrees of movement, stud 64 will travel from end 56 to end 58 of slot 52, arriving at the position shown in FIG. 10, with the blade still fully retracted. Continued movement of the scale will move the blade out of the pocket to the 90 degree position shown in FIG. 11. Completion of the 360 degree swing of the scale will bring the blade to full extension, and the tang corner 50 will positively engage abutment 60. It cannot swing back because stud 64 is solidly in engagement with end 58 of slot 52. Reversal of the described movements produces retraction of the blade. Contact of stud 64 with end 58 of slot 52 maintains the blade fully extended with corner 50 in contact with abutment 60, and contact of stud 64 with end 56 of slot 52 maintains the blade fully retracted with area 62 in contact with abutment 60.

Conventional knives are made with side scales and covers secured to the scales to complete the frame. In the present case it has been determined to make the scales much thicker than usual and to eliminate the covers. Thus the scales are one eighth inch thick and made of stainless steel and are extremely strong and rigid.

For safety and convenience lock means are provided to maintain the scales in registry both in storage and in use. Thus lock pin 66 is mounted in the first scale 12 and protrudes from the inner face of blade guard 14. A lock hole 68 is formed in the second scale 16 in registry with the lock pin, and the pin fits in the hole when the two scales are in registry. Because of the stiffness of the scales the force of the spring washers 40 maintains the lock members in firm engagement. To assist in separating the scales for manipulation a thumb notch 70 is formed in the free end of scale 12. When the second scale 16 is returned from a displaced position, sloping notches 72 and 74 formed in the inner face of the forward and back edges of scale 16 along the path of travel of the lock pin engage the pin traveling in either direction and cam the scales apart to facilitate movement of the lock pin into registry with the lock hole.

It will be apparent that the knife of this invention involves a minimum number of strong durable parts and with greatly improved locking means. In the event of damage to a blade, the knife can be disassembled, a new blade substituted, and the knife reassembled in considerably less than one minute.

Figure 17:
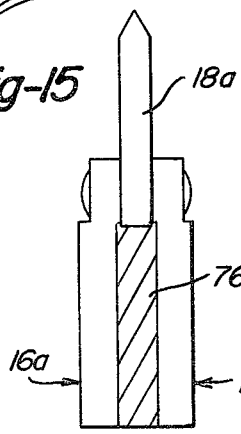
FIG. 17 shows an alternative knife form.

FIG. 17 shows an alternative embodiment wherein scales **12*a* and 16*a* are offset and provided with a spacer 76 so that blade 18*a*** can close without rubbing the scales. This eliminates the need for brass liners, bent blades and other expensive measures used to prevent abrasion.

The invention has been described in detail with particular reference to preferred embodiments thereof, but it will be understood that variations and modifications can be effected within the spirit and scope of the invention.

What is claimed is:

1. A folding locking blade knife comprising:

a first side scale having a pivot end, a free end, and a pivot aperture in the pivot ends;

and a second side scale having a pivot end, a free end, and a pivot aperture in the pivot end;

the two scales being substantially identical in planform;

a blade guard fixedly mounted on the inner face of the first scale and extending only along the rear margin and the free end marginal portion of the scale and terminating short of the pivot end of the scale;

a pivot post passing through both pivot apertures and retaining the two scales in assembled relation spaced apart by the blade guard to provide a protective pocket for a retracted blade;

and a cutting blade having a pivot end tang, a free end, and a pivot aperture in the tang, and being located between the two scales, and being pivotally mounted by its aperture on the pivot post for rotation between retracted and extended positions;

a lock pin projecting from the inner face of the blade guard near the free end of the scale and a corresponding lock hole through the second scale adapted to mate with the lock pin and retain the scales in registered overlying relation;

an arcuate slot through the tang of the blade centered on the pivot aperture and extending around it in an arc of substantially 180 degrees at the side remote from the free end of the blade with its ends in a lateral line across the blade passing through the pivot aperture;

and a single stud mounted in the second scale spaced laterally from the pivot aperture and projecting from the inner face of the second scale to engage in the arcuate slot in the blade;

the second scale, when released from the lock pin, being rotatable through approximately 180 degrees with respect to the blade and the first scale with the single stud traveling to the second end of the slot, and being rotatable through another approximately 180 degrees to swing the blade to fully extended position and return the scale to its initial overlying locked position with the first scale;

the tang of the blade retaining substantially its full width to the butt end and terminating in squared-off corners with a lateral rear marginal butt edge extending between them;

the corner portion of the marginal butt edge adjacent to the back of the tang contacting the forward end of the blade guard as a stop to limit the extension of the blade, and the tang front contacting the side edge of the forward portion of the blade guard to serve as a stop to limit retraction of the blade;

and the interaction of the single stud and the arcuate slot in the blade preventing extension of the blade when the second scale is in the blade retracting position and preventing retraction of the blade when the second scale is in the blade extending position.

2. A knife as claimed in claim 1; in which the corner portion of the marginal butt edge adjacent to the front of the tang terminates forward of the rear corner portion to provide clearance for passage of the front corner past the forward end of the blade guard during swinging of the blade between retracted and extended positions.

3. A knife as claimed in claim 2; in which the marginal butt edge of the blade between the forward and rear corners is generally arcuate in a radius of curvature substantially larger than that of the arcuate slot and corresponds generally with the curvature of the pivot ends of the scales.

4. A knife as claimed in claim 1; in which the pivot post comprises a first member including an internally threaded sleeve having an enlarged head and a second member including an externally threaded stem having an enlarged head;

the sleeve passing through the apertures in the scales and the blade, and the stem reaching into the sleeve, with the heads of the post members holding the components in assembled relation;

the post members being readily separable by relative rotation to disassemble the knife and rapidly replace the mounted blade by a substitute blade.

5. A knife as claimed in claim 4; in which a spring washer is mounted on each of the stem and the sleeve under the respective heads to apply spring pressure to the scales when the pivot post is tightly assembled and maintain the lock pin and the lock holes firmly engaged to prevent unintentional relative movement of the scales while permitting intentional separation of the lock pin from the lock hole against yielding resistance.

6. A knife as claimed in claim 5; in which an angled thumb notch is formed in the free end of the first scale and the blade guard to provide a gap between the first and second scales for separating them against the closing force of the spring washers.

7. A knife as claimed in claim 5; in which a sloping notch is formed in the inner face of the second scale at each of the forward and back edges along the path of travel of the lock pin to engage the lock pin and cam the scales apart to facilitate movement of the lock pin to registry with the lock hole.

* * * * *